United States Patent [19]

Szewczyk et al.

[11] Patent Number: 5,033,727

[45] Date of Patent: Jul. 23, 1991

[54] IN-LINE CHOPPER TO TRIM BACKBONE OF MULTIPLE PAGE SIGNATURES COLLATED ON AN INSERTER

[75] Inventors: Richard Szewczyk, Lincoln, Nebr.; Delmar O. Barton, Salem, Iowa

[73] Assignee: Metromail Corporation, Lincoln, Nebr.

[21] Appl. No.: 360,974

[22] Filed: Jun. 2, 1989

[51] Int. Cl.[5] ..... B65H 39/02

[52] U.S. Cl. ..... 270/54; 270/52; 270/58; 270/55

[58] Field of Search ..... 270/21.1, 52, 54, 55, 270/57, 58

[56] References Cited

U.S. PATENT DOCUMENTS

| | | | |
|---|---|---|---|
| 2,325,455 | 7/1943 | Williams . | |
| 3,260,517 | 7/1966 | Sather . | |
| 3,368,321 | 2/1968 | Sather et al. . | |
| 3,965,644 | 2/1976 | Stocker . | |
| 4,046,366 | 9/1977 | McCain | 270/54 |
| 4,203,334 | 5/1980 | Zettler | 270/58 |
| 4,273,319 | 6/1981 | Stocker | 270/58 |
| 4,527,791 | 7/1985 | Piotroski . | |
| 4,582,312 | 4/1986 | Abrams et al. . | |
| 4,604,849 | 8/1986 | Zemke et al. . | |
| 4,641,555 | 2/1987 | Johnson | 270/58 |
| 4,720,960 | 1/1988 | Green . | |
| 4,784,379 | 11/1988 | Vandersyde et al. . | |

FOREIGN PATENT DOCUMENTS

| | | | |
|---|---|---|---|
| 1102185 | 3/1961 | Fed. Rep. of Germany | 270/52 |
| 58-142879 | 8/1983 | Japan | 270/21.1 |

*Primary Examiner*—John T. Kwon
*Assistant Examiner*—Therese M. Newholm
*Attorney, Agent, or Firm*—Fleit, Jacobson, Cohn, Price, Holman & Stern

[57] ABSTRACT

The backbone portions of multiple page documents are trimmed by a chopper unit on a collating conveyor of an envelope inserter machine downstream of a supply station from which the documents are transferred to the conveyor, in order to establish collated sets of separated sheets onto which additional single insert sheets are added from other supply stations.

11 Claims, 2 Drawing Sheets

IN-LINE CHOPPER TO TRIM BACKBONE OF MULTIPLE PAGE SIGNATURES COLLATED ON AN INSERTER

BACKGROUND OF THE INVENTION

This invention relates generally to mail preparation machinery, and more particularly to the collation of insert sheets for stuffing into envelopes.

Mail preparing machines through which printed material is assembled, collated and inserted into envelopes are generally referred to as inserters. Such machines usually are provided with a plurality of insert sheet storing hoppers positioned along the path of a common conveyor onto which the insert sheets are transferred from the supply hoppers. The conveyor is intermittently driven in operative relation to the transfer of insert sheets thereto from the supply hoppers in order to assemble a collated set of insert sheets delivered by the conveyor to a stuffing station at which the collated sets of inserts are inserted into mailing envelopes. Inserter machines of such type are already well known and in use, such as those disclosed in U.S. Pat. Nos. 3,260,517 and 3,965,644. The aforementioned type of inserter machine has a fixed number of supply hoppers within which the inserts are stored at supply stations along the conveyor path to thereby ordinarily limit the number of insert sheets to be stuffed into the envelopes. Accordingly, if the number of inserts stuffed into the envelopes is to be increased, either a larger inserter machine with the requisite number of insert supply hoppers must be utilized or the existing inserter machine must be enlarged by roll-up and attachment thereto of a multi-station assembly of additional insert supply hoppers. In either event, the number of inserts stuffed into each envelope is determined by the number of insert supply hoppers available.

The broad concept of increasing the number of insert sheets to be collated by an inserter machine for stuffing into envelopes, without a corresponding increase in the number of supply hoppers from which the insert sheets are withdrawn, has already been proposed, for example, in U.S. Pat. No. 4,720,960 to Green. The objective of providing a number of sheets in each collated set greater than the number of available supply stacks is achieved according to the Green patent by means of a rather complex method involving the collation of insert sheets into preliminary sets, storing such preliminary collated sets and sequentially transferring the preliminary collated sets on trays to the transport conveyor on which final assembly of collated sheets is performed and delivered to the envelope stuffing station.

It is therefore an important object of the present invention to achieve the overall objective of increasing the insert sheet capacity of an inserter machine, as referred to by way of example in the aforementioned Green patent, in a simpler and more economical and reliable fashion.

SUMMARY OF THE INVENTION

In accordance with the present invention, an inserter machine with a predetermined number of insert sheet supply stations, spaced along the common collating conveyor, includes at least one supply station at which multiple page signature documents are stored, stacked in a supply hopper. The latter supply station is located upstream of the other supply stations from which single sheet inserts are withdrawn and transferred onto the common collating conveyor. Located downstream of such multiple page signature supply station (and upstream of the other supply stations), is a chopper unit operatively aligned with the common collating conveyor to separate the assembled multiple sheets associated with the multiple page signature documents by severing therefrom their backbone portions through which the individual sheets or pages thereof are held assembled. Accordingly, the number of insert sheets transferred to the collating conveyor from the multiple page signature supply stations is greater than the number of such multiple page signature supply stations. The total number of insert sheets in each collated set reaching the envelope stuffing station is therefore greater than the total number of insert supply stations.

The number of multiple page signature supply stations located upstream of the sheet separating chopper assembly along the common collating conveyor path, may vary in accordance with different requirements and, in certain embodiments of the invention, may be removably attached to an existing inserter machine in the form of a multi-station roll-up assembly. Also according to one embodiment of the invention, the chopper assembly includes a stationary blade having an upper surface aligned with the transport plane of the common collating conveyor and a movable blade operatively aligned therewith for severing the backbone portions of the multiple page signature documents transported by the conveyor along the transport plane. A movable hold down bar clamps the multiple page signature documents to the transport plane just before the movable blade undergoes its cutting action in order to provide proper and square cuts of the backbone portions of the multiple page signature documents.

BRIEF DESCRIPTION OF THE DRAWING FIGURES

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF PREFERRED EMBODIMENT

Figure 1:
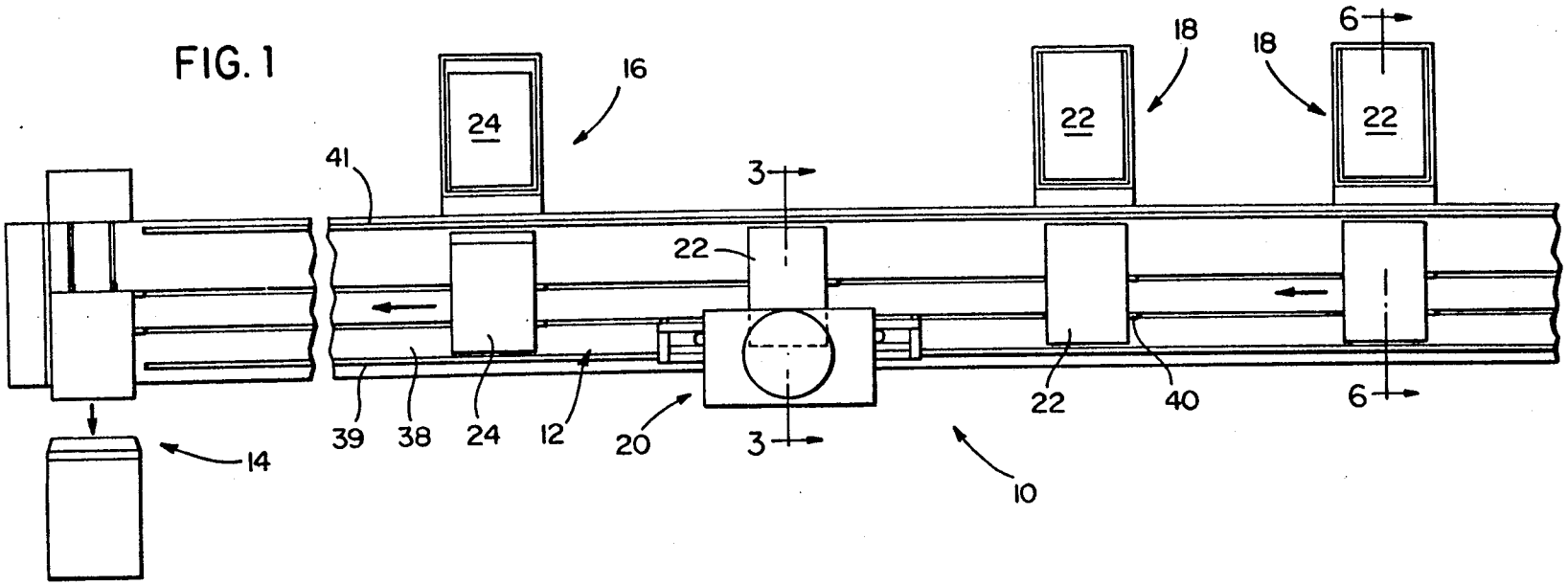
FIG. 1 is a schematic top plan view of an operational arrangement in an inserter machine, modified in accordance with the present invention.

Referring now to the drawing in detail, FIG. 1 schematically illustrates an inserter machine generally referred to by reference numeral 10 which includes a common collating conveyor generally referred to by reference numeral 12, having a fixed path terminated at one end by an envelope stuffing station generally referred to by reference numeral 14. Such inserter machines are generally well known in the art and in common use today for the preparation of mailing packages. The machine has associated therewith a set of the usual single insert sheet supply stations, respectively referred to by reference numeral 16, as well as an additional set of insert supply stations, respectively referred to by reference numeral 18, of generally well known construction. The set of supply stations 18 are located upstream of the other set of supply stations 16 in accordance with the present invention. Also, in accordance with the present invention, a chopper assembly generally referred to by reference numeral 20 is located between the sets of supply stations 16 and 18, downstream of the supply stations 18 and upstream of the supply stations 16 as shown in FIG. 1.

Figure 6:
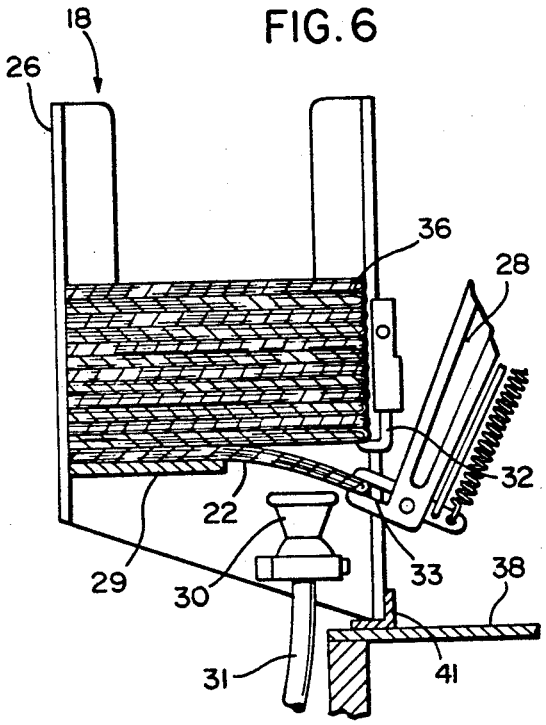
FIG. 6 is a section view through one of the insert supply stations, taken substantially through a plane indicated by section line 6—6 in FIG. 1.

The supply stations 16 and 18 differ from each other in that the supply stations 18 store therein stacks of multiple page signature documents 22 whereas the supply stations 16 store stacks of single sheet inserts 24. As more clearly seen in FIG. 6, each of the supply stations 18 includes a supply hopper 26 of a generally well known construction within which a stack of the multiple page documents 22 is stored. Such multiple page documents are transferred to the common collating conveyor 12 in a manner generally well known in the art by means of a pivoted gripper arm 28. Typically, a document 22 is withdrawn from the bottom of the stack during an operational cycle initiated by upward displacement of a suction cup 30 into contact therewith. Vacuum pressure is then automatically applied through conduit 31 to cause the bottom document to adhere to the suction cup as it is displaced downwardly to pull the bottom document away from the rest of the stack. A separator foot 32 then swings into the stack to maintain separation of the bottom document as vacuum is removed and the suction cup is withdrawn downwardly. The gripper arm 28 is then swung into the stack with its jaw 33 opened and is clamped onto the separated bottom document as shown in FIG. 6 before it begins to swing away from the stack pulling the bottom document out of the stack. The gripper jaw is opened to drop the withdrawn document onto the conveyor as the gripper arm reaches its retracted position at the end of the operational cycle.

As will be noted from FIG. 6, each of the documents 22 in the hopper 26 is formed by a plurality of individual sheets that are interconnected or held assembled to each other along a backbone edge portion 36, overhanging the shelf 29 in overlying relation to the suction cup 30.

Referring again to FIG. 1, it will be observed that the multiple page signature documents 22 are collated into sets by transfer from the supply stations 18 in overlying relationship to each other on the conveyor 12 upstream of the chopper assembly 20. Such collated sets of multiple page signature documents are moved along the fixed raceway track 38 of the conveyor 12 between its front and rear rails 39 and 41 by its chain mounted pins 40. The collated sets of multiple signature documents are accordingly displaced through the chopper station before they arrive at the supply stations 16 at which the collated sets are enlarged by transfer thereto of single sheet inserts in order to eventually deliver collated sets of inserts formed from the multiple pages of the documents 22 and the individual sheets of the inserts 24. However, before the multiple sheet documents 22 reach the supply station 16, the assembled sheets thereof are disassembled or separated by severing of the aforementioned backbone portions 36. The severing or trimming of such backbone portions of the documents 22 is achieved by means of the chopper assembly 20.

Figure 2:
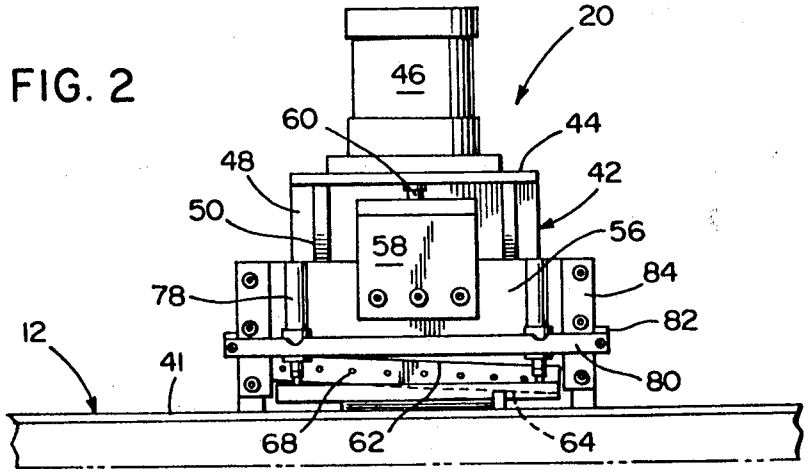
FIG. 2 is a partial rear elevation view of the chopper station associated with the inserter machine arrangement shown in FIG. 1.
Figure 4:
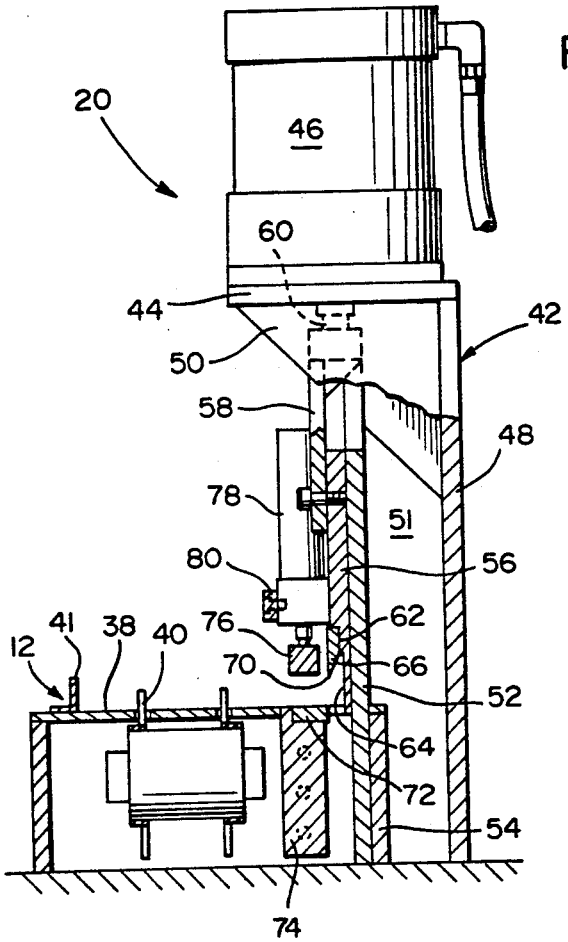
FIG. 4 is a partial side section view through the chopper device, without any insert documents thereat.
Figure 3:
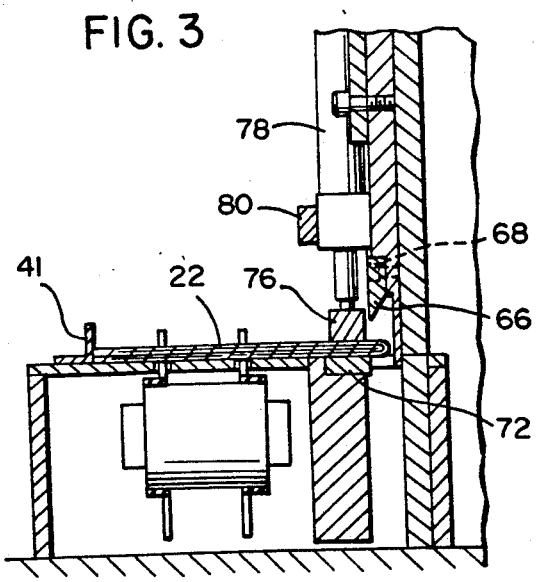
FIG. 3 is a section view of the chopper device at the chopper station taken substantially through a plane indicated by section line 3—3 in FIG. 1, with the cutting blade in a retracted position.

As more clearly seen in FIGS. 2, 3 and 4, the chopper apparatus 20 includes a stationary frame assembly generally referred to by reference numeral 42 having a top supporting flange 44 on which a compressed air type of power operating cylinder assembly 46 is mounted. The top supporting flange 44 extends rearwardly from a plate 48 of the frame assembly interconnected with the supporting flange 44 by a pair of triangular braces 50. Side plates 51 connected to the plate 48 of the frame assembly are interconnected by a guide plate 52 in spaced relation to the plate 48. The guide plate 52 extends beyond the plate 48 parallel to the fixed path of the collating conveyor 12 to which it is fixed at its lower end abutting the side frame 54 of the conveyor. The guide plate 52 thereby presents a guide surface in slidable contact with a blade holder 56 that is vertically displaceable perpendicular to the fixed conveyor path and in operative alignment therewith.

As more clearly seen in FIGS. 2 and 4, the blade holder 56 is connected by means of a mounting plate 58 to the lower end of a piston rod 60 projecting from the power operated cylinder device 46 through an opening in the supporting flange 44. The blade holder 56 has stepped recesses 62 and 64 along its lower edge portion which extend at an acute angle to the fixed conveyor path as more clearly seen in FIG. 2 so as to position within the recess 62, a blade element 66. The blade element 66 is mounted in the recess 62 of the blade holder by means of a plurality of screws and terminates at a knife edge 70 extending cross-sectionally at an angle from a plane surface toward the recess 62 in spaced relationship to the recess 64. The plane surface of the blade element 66 terminated by the knife edge 70, is parallel to the vertical direction along which it is displaced by the power operated cylinder assembly 46 in close spaced relationship to the vertical end surface of a stationary blade element 72 mounted within a recess formed on the top of a support member 74 fixed to the conveyor frame below track 38 in spaced relationship to the frame mounted guide plate 52.

The fixed horizontal surface of the stationary blade element 72 underlies a horizontal hold down bar 76 connected to the lower ends of piston rods projecting from a pair of fluid operated cylinder devices 78 as more clearly seen in FIGS. 2 and 4. The fluid operated cylinder devices 78 are mounted in fixed spaced relationship on either side of the mounting plate 58, to which the movable blade holder 56 is connected, by means of a mounting bar 80 interconnected with the guide plate 52 at its opposite ends by means of a pair of mounting brackets 84. The mounting bar 80 is fixedly spaced forwardly of the guide plate 52 by means of spacers 82. As a result of the foregoing arrangement, the hold down bar 76 is properly aligned for engagement with the multiple page documents 22 at the chopper station just before the backbone portions 36 thereof are trimmed by the cutting action of the movable blade element 66.

Figure 5:
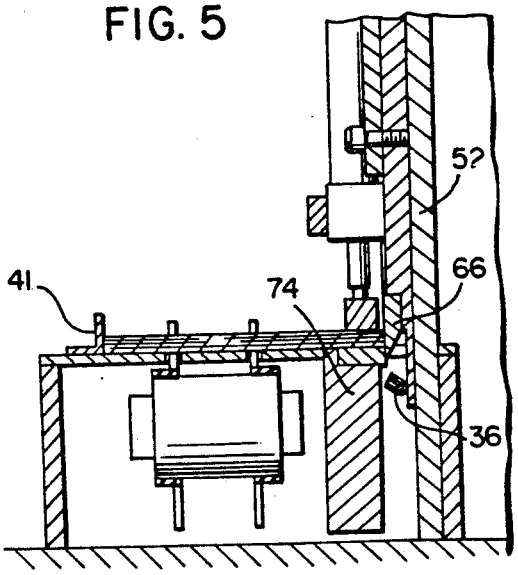
FIG. 5 is a section view similar to FIG. 4, with the cutting blade in an actuated position.

Clamping of a multiple page signature document 22 in the chopper station to the stationary blade element 72 by means of the hold down bar 76 is shown by FIG. 3. FIG. 5 shows the blade element displaced through its cutting position severing the backbone portion 36 from the multiple page document 22 to thereby result in the separation of the pages or sheets of the document assembly. The severed backbone portion 36 is free to drop through the space between the guide plate 52 and the stationary blade support member 74 as shown. Effective removal of the backbone portion is thereby achieved to separate each of the documents 22 into individual insert sheets over which additional insert sheets are collated by intermittent movement of the collated sets on the conveyor 12 past the supply stations 16 from which single sheet inserts are withdrawn.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with an inserter machine having a predetermined number of supply stations at which documents are stored, conveyor means for transport of said documents along a fixed path and means for transferring said documents from the supply stations to the conveyor means in overlying relation to each other forming sets of collated insert sheets adapted to be respectively inserted into envelopes, the improvement residing in said predetermined number of the supply stations being less than the number of insert sheets in each of the collated sets, the documents stored in at least one of the supply stations being document assemblies of multiple superposed insert sheets joined along corresponding margins and transferred to the conveyor means spaced along the conveyor path from the other of the supply stations, and means mounted in operative relation to the conveyor means downstream of said one of the supply stations along said conveyor path for disassembling the joined margins of multiple insert sheets of each assembly of superposed insert sheets, each from the remaining sheets of each of the document assemblies on the conveyor means.

2. The combination of claim 1 wherein each of said multiple sheet document assemblies includes a backbone portion extending along corresponding margins of the superposed sheets interconnecting the multiple insert sheets thereof.

3. The improvement as defined in claim 2 wherein said disassembling means comprises chopper means for cutting the document assemblies and means mounting the chopper means in operative alignment with said conveyor path for severing the backbone portions from the document assemblies in response to said cutting thereof.

4. The combination of claim 3 wherein said chopper means includes a stationary blade having a surface fixedly positioned in a plane parallel to the conveyor path underlying the backbone portions of the document assemblies conveyed along said conveyor path, holddown means for clamping the document assemblies to said surface of the stationary blade between the intermittent movement of the conveyor means and power operated blade means displaceable in transverse intersecting relation to the plane of said surface for trimming the backbone portions to effect said severing thereof from the insert sheets of the document assemblies while clamped to said surface of the stationary blade.

5. In combination with an inserter machine, apparatus for separating multiple sheet documents, each consisting of multiple folded insert sheets, into plural insert sheets collated into sets conveyed along a fixed path by a conveyor, including chopper means for cutting the documents, each of said multiple sheet documents having a folded portion interconnecting the multiple folded insert sheets thereof along corresponding margins of the sheets of each document prior to separation, and means mounting the chopper means in operative alignment with said fixed path of the conveyor for severing the folded portions from the multiple sheet documents in response to said cutting thereof to thereby separate each sheet of each multiple sheet document from the other sheets thereof.

6. The combination of claim 5 wherein said chopper means includes a stationary blade having a surface fixedly positioned in a plane parallel to the fixed path of the conveyor underlying the folded portions of the documents conveyed along said fixed path, holddown means for clamping the documents to said surface of the stationary blade and power operated blade means displaceable in transverse intersecting relation to the plane of said surface for trimming the folded portions to effect said severing thereof from the insert sheets of the documents while clamped to said surface of the stationary blade.

7. A method of collating sheets from a predetermined number of supply stacks into collated sets, wherein the number of sheets in each of the collated sets may be greater than said predetermined number of the supply stacks, comprising the steps of: mounting said predetermined number of the supply stacks along a conveyor path; storing separated insert sheets in each of the supply stacks except for at least one of the supply stacks; storing separate assemblies of superposed multiple sheets, joined together along one set of corresponding margins, in said one of the supply stacks; sequentially transferring and advancing the separate assemblies of the multiple sheets and the separated insert sheets from the respective supply stacks to and along the conveyor path to form the collated sets; and trimming the separate assemblies of the multiple sheets, along said one set of corresponding margins, on the conveyor path to disassemble the multiple sheets each from the other sheets thereof before transfer into the collated sets.

8. The method of claim 7 wherein the said at least one of the supply stacks is disposed upstream of the other of the supply stacks.

9. In combination with an inserter machine having a predetermined number of supply stations at which documents are stored, intermittently movable conveyor means for transport of said documents along a fixed path and means for transferring said documents from the supply stations to the conveyor means in overlying relation to each other forming sets of collated insert sheets adapted to be respectively inserted into envelopes, the improvement residing in said predetermined number of the supply stations being less in number than the insert sheets in each of the collated sets, the documents stored in at least one of the supply stations comprising documents of multiple superposed sheets held assembled along backbone portions extending along corresponding margins of said sheets of each document, and means for trimming the backbone portions from the documents transferred to the conveyor means from said one of the supply stations to thereby separate the superposed sheets, of each document from said one of the supply stations, each from the other sheets thereof.

10. The improvement as defined in claim 9 wherein said trimming means includes a chopper operatively aligned with said conveyor path.

11. The improvement as defined in claim 9 wherein said one of the supply stations is located upstream of the other of the supply stations.

* * * * *